US007540604B2

(12) United States Patent
Izawa et al.

(10) Patent No.: US 7,540,604 B2
(45) Date of Patent: Jun. 2, 2009

(54) INKJET RECORDING APPARATUS

(75) Inventors: Hideo Izawa, Narashino (JP); Akira Ishikawa, Narashino (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 499 days.

(21) Appl. No.: 11/494,024

(22) Filed: Jul. 26, 2006

(65) Prior Publication Data

US 2007/0035572 A1 Feb. 15, 2007

(30) Foreign Application Priority Data

Aug. 9, 2005 (JP) ..... 2005-230505

(51) Int. Cl.
*B41J 29/13* (2006.01)
*B41J 2/14* (2006.01)

(52) U.S. Cl. ..... 347/108; 347/49

(58) Field of Classification Search ..... 347/108, 347/13, 49, 50
See application file for complete search history.

(56) References Cited

U.S. PATENT DOCUMENTS 5,825,392 A 10/1998 Mochizuki
2001/0004264 A1 6/2001 Schartner
2005/0046665 A1 3/2005 Matsuba et al.

FOREIGN PATENT DOCUMENTS

JP 9-1789 1/1997

OTHER PUBLICATIONS

European Search Report issued in the corresponding foreign application No. EP 06 01 6082, Feb. 27, 2008.

*Primary Examiner*—Shih-wen Hsieh
(74) *Attorney, Agent, or Firm*—Cohen Pontani Lieberman & Pavane LLP

(57) ABSTRACT

It is rendered possible to attach and detach an inkjet line head chassis to and from a controller housing in an inkjet recording apparatus. To this end, the inkjet recording apparatus in which the inkjet line head chassis (2) is detachably attached to a portion of the controller housing (1) comprises: a bracket (4) mounted to the controller housing and movable upward and downward, the bracket supporting the inkjet line head chassis so that the chassis can be attached and detached unidirectionally; a drive plate (18) mounted in the controller housing so as to be rotatable in a plane parallel to a direction in which the bracket is moved vertically; a link mechanism for coupling the drive plate and the bracket to move the bracket vertically when the dive plate is rotated; and a fluid cylinder (19) coupled to the drive plate.

2 Claims, 3 Drawing Sheets

INKJET RECORDING APPARATUS

TECHNICAL FIELD

The present invention relates to an inkjet recording apparatus in which an inkjet line head chassis having an inkjet line head comprising a plurality of ink nozzles arranged in a line is detachably attached to a controller housing.

BACKGROUND ART

Attaching and detaching such an inkjet line head chassis to and from the controller housing in the conventional inkjet recording apparatus has been manually carried out by an operator (see for example, JP H09-1789 A). And, the inkjet line head chassis is attached to the controller housing by manually mounting the inkjet line head chassis to the controller housing and then fastening the manually mounted inkjet line head chassis to the controller housing by screws or the like, using a tool.

Since mounting and dismounting or detaching the inkjet line head chassis to and from the controller housing and fastening them together have thus been manually carried out and using a tool by an operator, there has been the problem with the prior art that the operations to attach and to detach the inkjet line head chassis to and from the controller housing are time-consuming and severally necessitate the tool.

DISCLOSURE OF THE INVENTION

In view of the problem mentioned above in the prior art, it is an object of the present invention to provide an inkjet recording apparatus in which attaching and detaching an inkjet line head chassis to and from a controller housing can be carried out without necessitating a tool and in a simple operation.

In order to achieve the first object mentioned above there is provided in accordance with the present invention an inkjet recording apparatus in which an inkjet line head chassis is detachably attached to a portion of a controller housing, characterized in that it comprises: a bracket mounted to the controller housing and movable upward and downward, the bracket supporting the inkjet line head chassis so that chassis can be attached and detached unidirectionally; a drive plate mounted in the controller housing so as to be rotatable in a plane parallel to a direction in which the bracket is moved vertically; a link mechanism for coupling the drive plate and the bracket to move the bracket vertically when the dive plate is rotated; and a fluid cylinder coupled to the said drive plate.

According to the present invention, it is possible to attach and detach an inkjet line head chassis to and from the controller housing without necessitating a tool and in a simple operation.

Preferably, the fluid cylinder is an air cylinder having a cushioning property in its stroke direction. Then, the stroke length of upward movement of the air cylinder can be made a little greater than that of the bracket.

DESCRIPTION OF PREFERRED EMBODIMENTS

Figure 1:
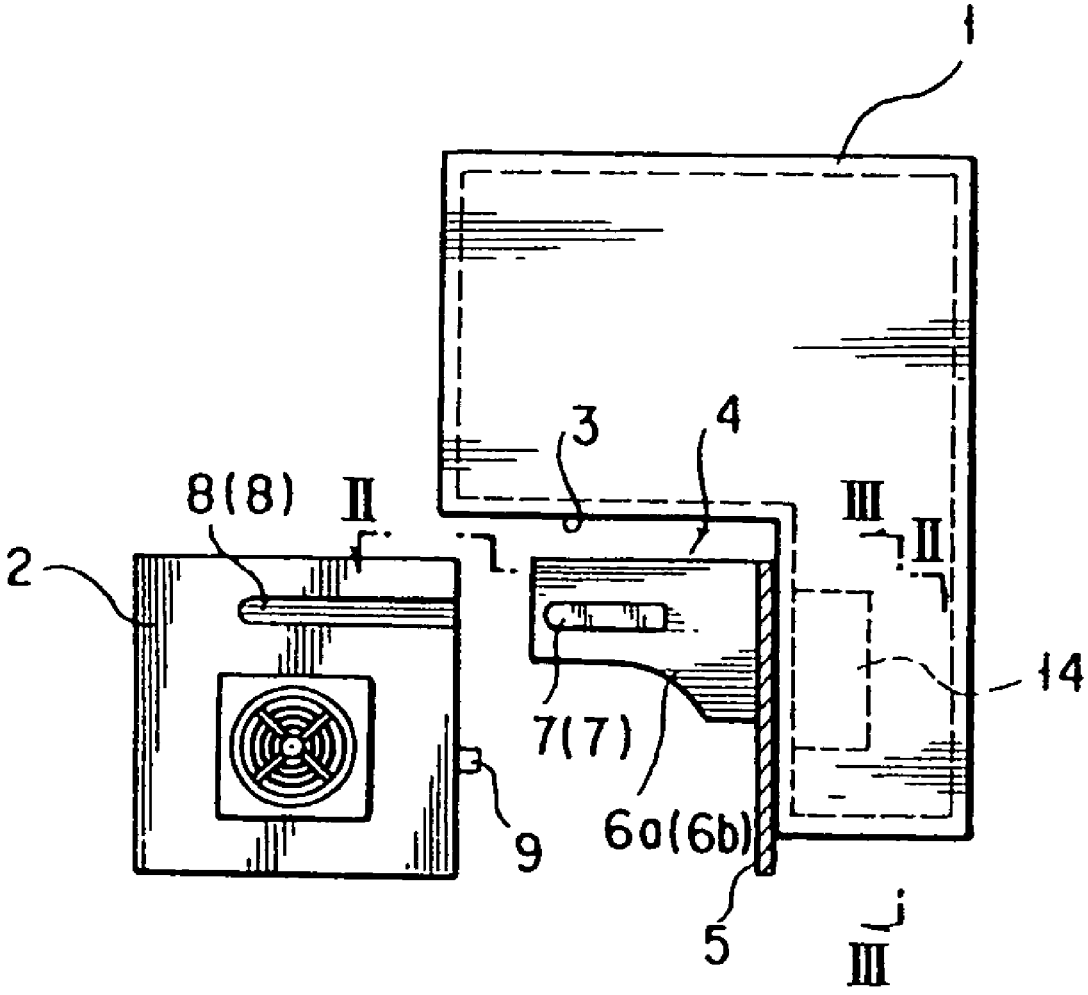
FIG. 1 is a side view in part broken and decomposed illustrating an inkjet recording apparatus according to the present invention.
Figure 2:
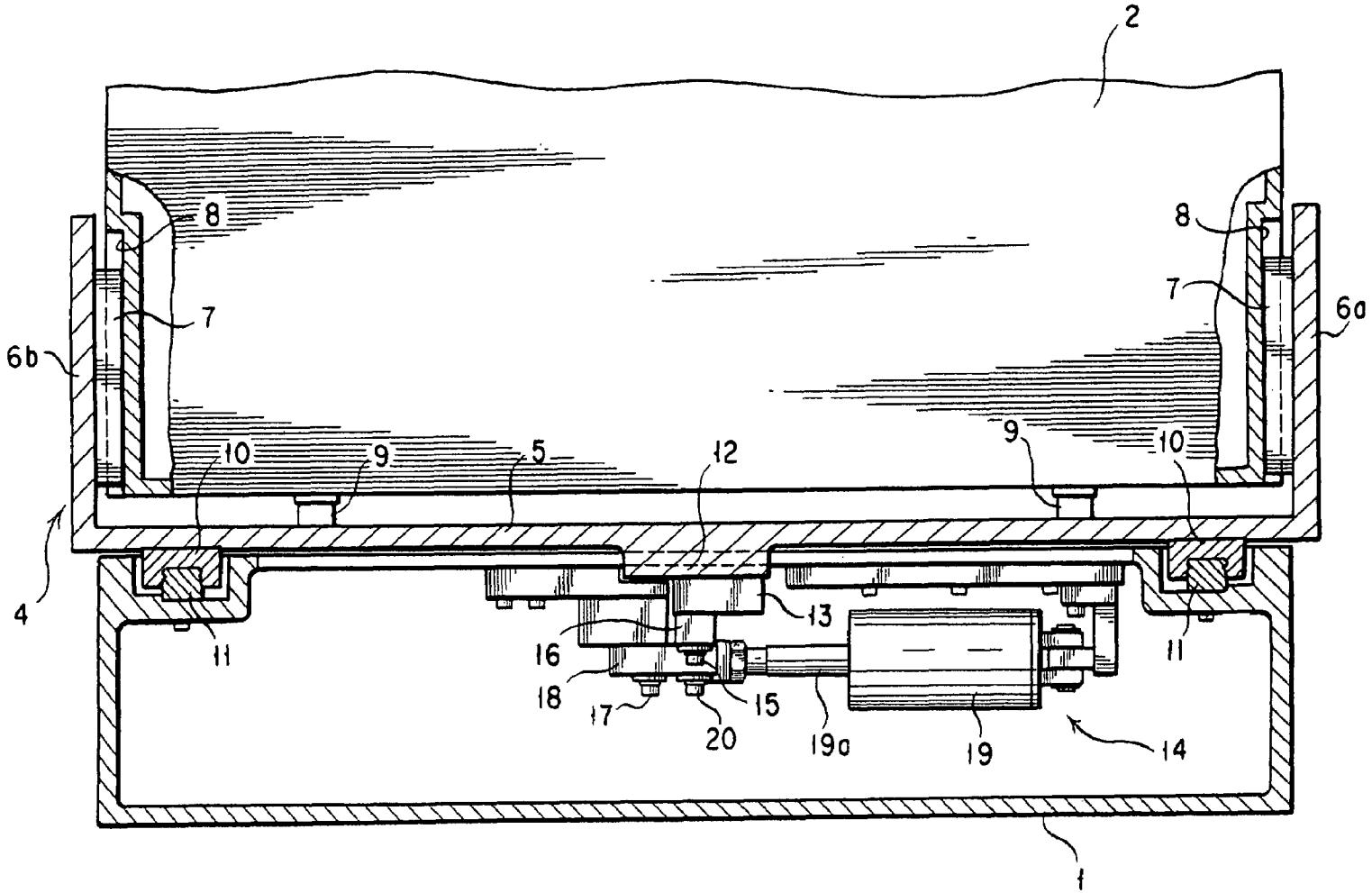
FIG. 2 is a cross sectional view taken along the line II-II in FIG. 1 and as viewed in the direction of the arrow.
Figure 3:
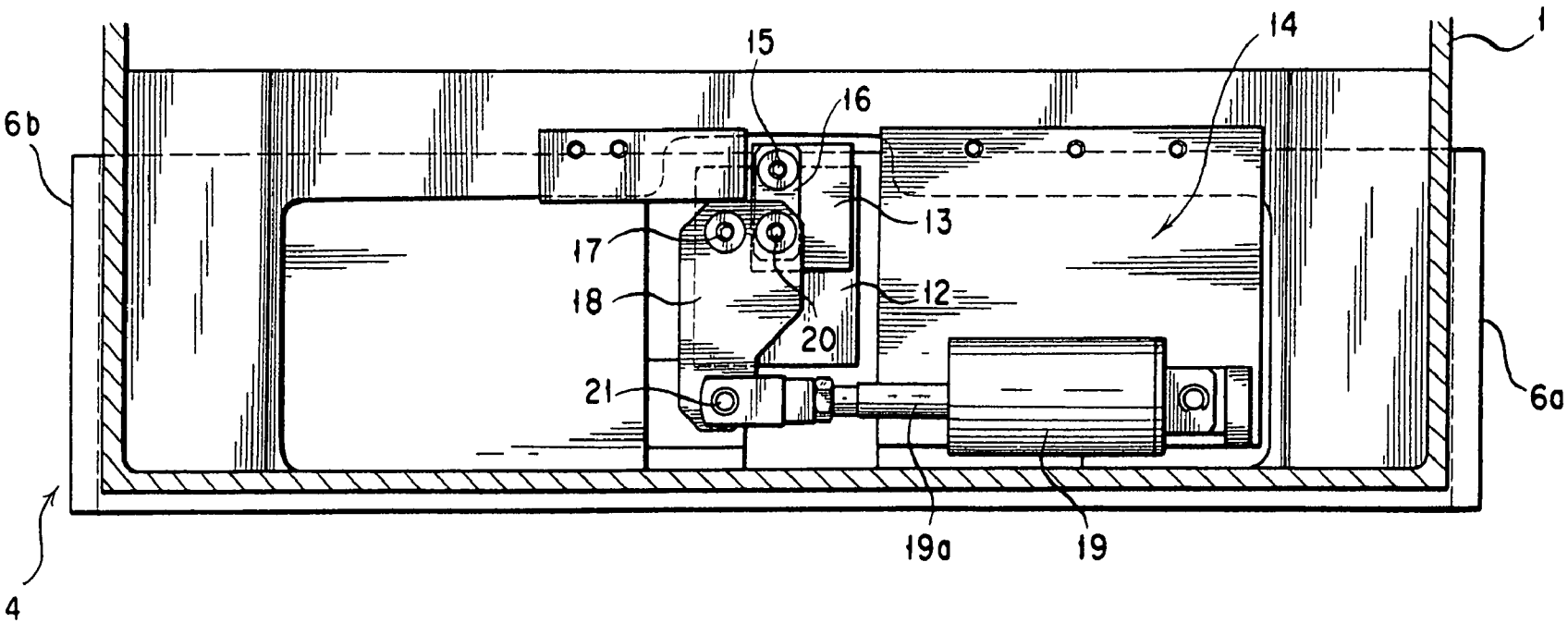
FIG. 3 is a cross sectional view taken along the line III-III in FIG. 1 and as viewed in the direction of the arrow.

FIGS. 1 to 3 show essential parts of an inkjet recording apparatus according to the present invention.

In FIGS. 1 to 3, there are shown a controller housing 1 and an inkjet line head chassis 2 to be detachably mounted to a lower portion of the controller housing 1. The inkjet line head chassis 2 is provided in its lower surface with an inkjet line head of ink nozzles as they are directed downward.

The controller housing 1 is formed in its lower front section with a reverse L-shaped cutout 3. On the inner side of this cutout 3, a bracket 4 is supported so that it can be moved upward and downward over a prescribed stroke length. And, the bracket 4 comprises a back plate 5 and a left and a right arm 6*a* and 6*b* which project forward at the left and right hand sides of the back plate 5.

The left and right arms 6*a* and 6*b* are formed on their inner sides with horizontally extending key members 7 and 7. The key members 7 and 7 can slidably fit in horizontally extending bearing grooves 8 formed in both sides of the inkjet line head chassis 2 to support the inkjet line head chassis 2 slidably with the bracket 4 so that the former can move forwards and backwards (unidirectionally) relative to the latter and can be detached from the latter forwards. The inkjet line head chassis 2 is formed with stoppers 9 which can abut on the back plate 5 to properly positioning the inkjet line head chassis 2 at an innermost position.

The key members 7, 7 and the bearing grooves 8, 8 have their vertical position set such that when they fit in each other and the bracket 4 is at its lowered position, there is a space between the lower face of the controller housing 1 at the cutout 3 and the upper face of the inkjet line head chassis 2.

The back plate 5 of the bracket 4 is formed on its back with vertical guide grooves 10 and 10 at both left and right hand sides of its center with respect to its width direction. Also, key members 11 and 11 which can slidably fit in these guide grooves 10 and 10 are fastened to the vertical wall of the controller housing 1 at the cutout 3. Thus, the grooves 10, 10 are guided by the key members 11, 11, so that the bracket 4 can be moved upward and downward over a prescribed stroke length set by stoppers (not shown). Then, this stroke length, i.e. elevating length is designed to be greater than the vertical space initially existing when the inkjet line head chassis 2 is installed in the cutout 3.

That vertical section of the controller housing 1 which defines the cutout 3 is formed in its central portion with respect to its lateral direction with an opening, and the back plate 5 of the bracket 4 is formed in its backside opposed to the opening with a pedestal 12 to which a coupling plate 13 is fastened.

In the inside of the controller housing 1 which corresponds to the vertical section of the cutout 3, there is provided an elevating device 14 which is coupled to the coupling plate 13 for moving the bracket 4 upward and downward.

This elevating device 14 includes a connecting member 16 which is coupled by a first pin 15 rotatably to the coupling plate 13 fastened to the bracket 4 so as to be rotatable in a right and left direction (horizontally) in a plane parallel to a direction in which the bracket 4 is moved upward and downward. The elevating device 14 also includes a drive plate 18 which is coupled by a second pin 17 rotatably to the housing side so as to be rotatable in a right and left direction (horizontally). The second pin 17 is mounted at a position deviated in a right and left direction (horizontally) from the position of the first pin 15. The elevating device 14 further includes an air cylinder 19 which is substantially horizontally located above or below, e. g., below the second pin 17 and whose base end is pivoted at the housing side. The drive plate 18 and the connecting member 16 are coupled together by a third pin 20 directly below the first pin 15 and laterally to the second pin 17, and the drive plate 18 is coupled to the end of a piston rod 19*a* of the air cylinder 19 by a fourth pin 21 below the second pin 17.

An expanding and contracting operation of the air cylinder 19 causes the drive plate 18 to be rotated about the second pin 17 and in turn the third pin 20 mounted on the drive plate 18 to be moved upward and downward, with the result that the bracket 4 is moved upward and downward via the connecting member 16. The elevating length of the bracket is determined according to a ratio of distances between the pins, namely a linkage ratio with respect to a stroke of the air cylinder 19. And then, an upper stroke end position of the bracket 4 corresponds to a ascent limit position of the inkjet line head chassis 2 supported by the bracket 4. Note in this connection that since the air cylinder 19 is used for an actuator to move the bracket 4 upward and downward, if it has an elastic (cushioning) property in its stroke direction at its stroke end, its elevating length may be made a little greater than that of the bracket 4.

Mention is made below of attaching and detaching operations of the inkjet line head chassis 2 to and from the controller housing 1 in the arrangement described above.

An inkjet line head chassis 2 taken in operator's hands or moved on a carriage is guided from the front into the cutout 3 of the controller housing 1 by fitting the support grooves 8 and 8 with the key members 7 and 7 of the bracket 4 lying in its lowered position and is supported there.

Next, the air cylinder 19 in the elevating device 14 is expansively and contractively (in this example, contractively) operated to move the bracket 4 upward and then to move the inkjet line head chassis 2 supported by the bracket 4 upward until the same takes a prescribed position in the cutout 3 of the controller housing 1 and fastened there.

Although not shown, positioning is then effected by the mutual engagement of a male and a female engaging piece provided at opposed portions of the inkjet line head chassis 2 and the controller housings 1.

Wiring connectors, ink piping connectors and couplers provided for the inkjet line head chassis 2 are designed to be connected and disconnected when the elevating device 14 moves the chassis 2 supported by the bracket 4 upward and downward.

While in this form of implementation, use is made of the air cylinder 19 for an actuator to move the bracket 4 upward and downward, a liquid pressure cylinder which has almost no cushioning property may be used for an actuator, if it is made to agree in elevating length with the bracket 4.

What is claimed is:

1. An inkjet recording apparatus in which an inkjet line head chassis is detachably attached to a portion of a controller housing, characterized in that it comprises:

a bracket mounted to the controller housing and movable upward and downward, said bracket supporting the inkjet line head chassis so that the chassis can be attached and detached unidirectionally;

a drive plate mounted in the controller housing so as to be rotatable in a plane parallel to a direction in which the bracket is moved vertically;

a link mechanism for coupling said drive plate and said bracket to move the bracket vertically when the dive plate is rotated; and a fluid cylinder coupled to said drive plate.

2. An inkjet recording apparatus as set forth in claim 1, characterized in that said fluid cylinder is an air cylinder having a cushioning property in its stroke direction.

* * * * *